United States Patent [19]

Croley

[11] Patent Number: 4,607,785

[45] Date of Patent: Aug. 26, 1986

[54] FIBERBOARD FLAT WITH JOINED STRENGTHENED CORNERS FOR SETTING UP INTO AN ANGULAR TRAY AND THE SET-UP TRAY

[75] Inventor: Thomas E. Croley, Worthington, Ohio

[73] Assignee: Willamette Industries, Delaware, Ohio

[21] Appl. No.: 724,868

[22] Filed: Apr. 19, 1985

[51] Int. Cl.[4] ..... B65D 5/36

[52] U.S. Cl. ..... 229/41 B; 229/108; 229/41 R; 229/41 C; 229/110; 229/109

[58] Field of Search ..... 229/41 R, 41 B, 41 C, 229/41 D, 32, 33, 35, 36, 30, 31 R

[56] References Cited

U.S. PATENT DOCUMENTS

| | | | |
|---|---|---|---|
| 686,808 | 11/1901 | Hirsch | 229/41 R |
| 899,654 | 9/1908 | Bloomer | 229/41 B |
| 1,102,877 | 7/1914 | Clark | 229/D16 A |
| 1,485,584 | 3/1924 | Bergstein | 229/32 |
| 1,563,907 | 12/1925 | Koff | 229/32 X |
| 1,656,307 | 1/1928 | Walter | 229/32 X |
| 1,673,109 | 6/1928 | Fenstermacher | 229/D16 A |
| 2,933,232 | 4/1960 | Bugnone | 229/41 B |
| 3,704,824 | 12/1972 | Croley | 229/32 |

FOREIGN PATENT DOCUMENTS

| | | | |
|---|---|---|---|
| 1320926 | 2/1963 | France | 229/41 C |
| 1510726 | 12/1967 | France | 229/31 R |
| 742750 | 1/1956 | United Kingdom | 229/33 |

*Primary Examiner*—William Price
*Assistant Examiner*—Gary E. Elkins
*Attorney, Agent, or Firm*—William V. Miller

[57] ABSTRACT

A flat of fiberboard in knocked-down form for setting up into a tray which has strengthened corners. The flat consists of laminated strength-producing connecting corner tabs between hinged side-wall forming flaps. The tabs are formed on the ends of the flaps and some of the flaps are provided with angular fold lines which provide foldable sections in these flaps, the fold lines extending from the flap hinge lines of the respective flaps to a point within the flaps and a slit being provided from that point in each flap to the outer edge of the flap to permit folding of the foldable flap sections.

6 Claims, 13 Drawing Figures

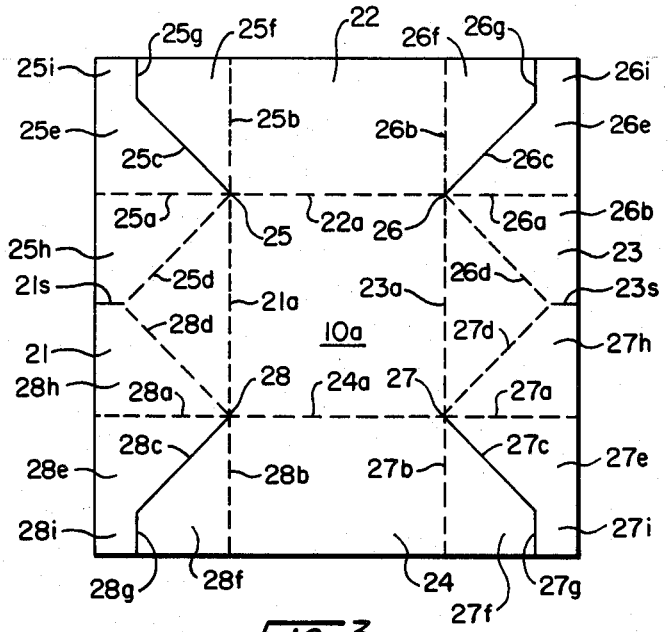
FIG. 3
FIG. 4
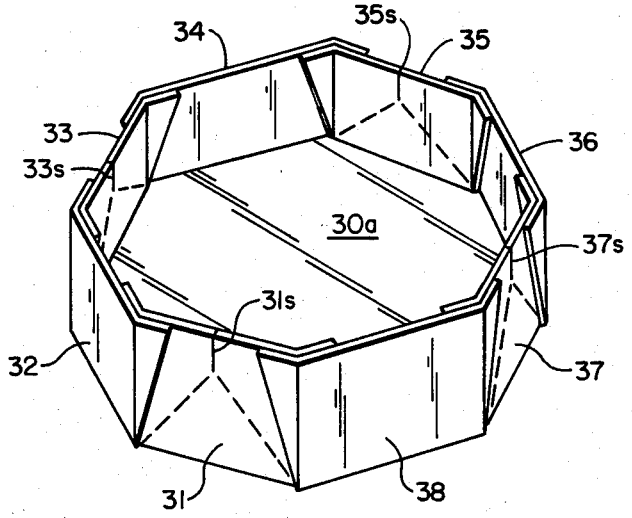

FIG. 9
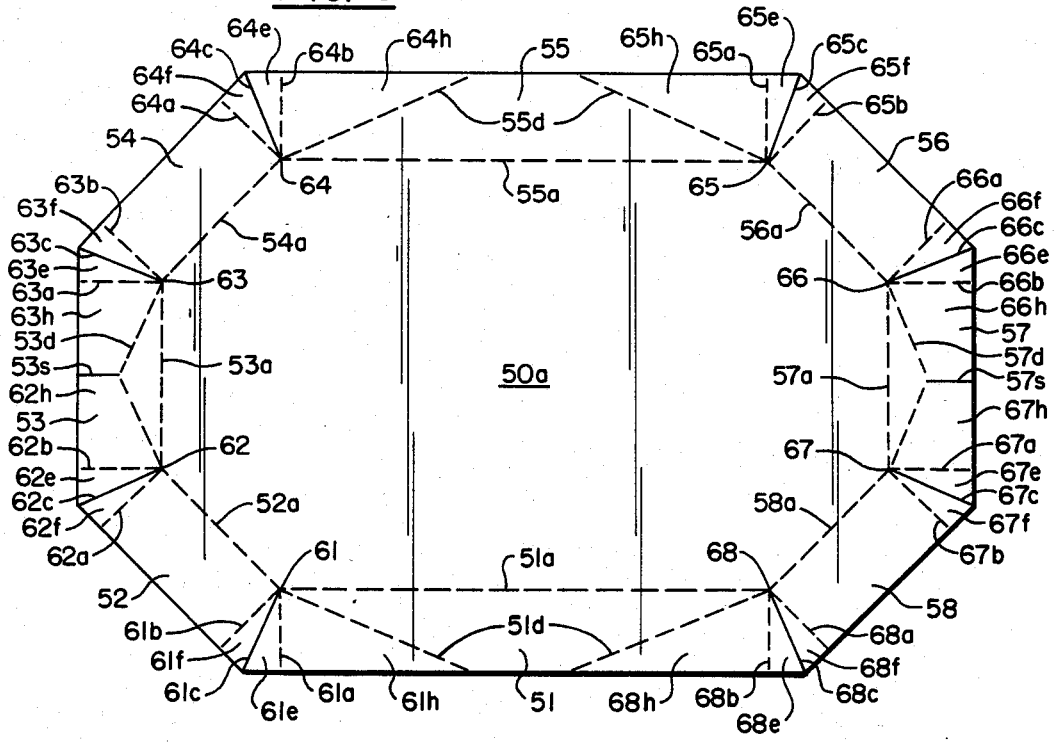
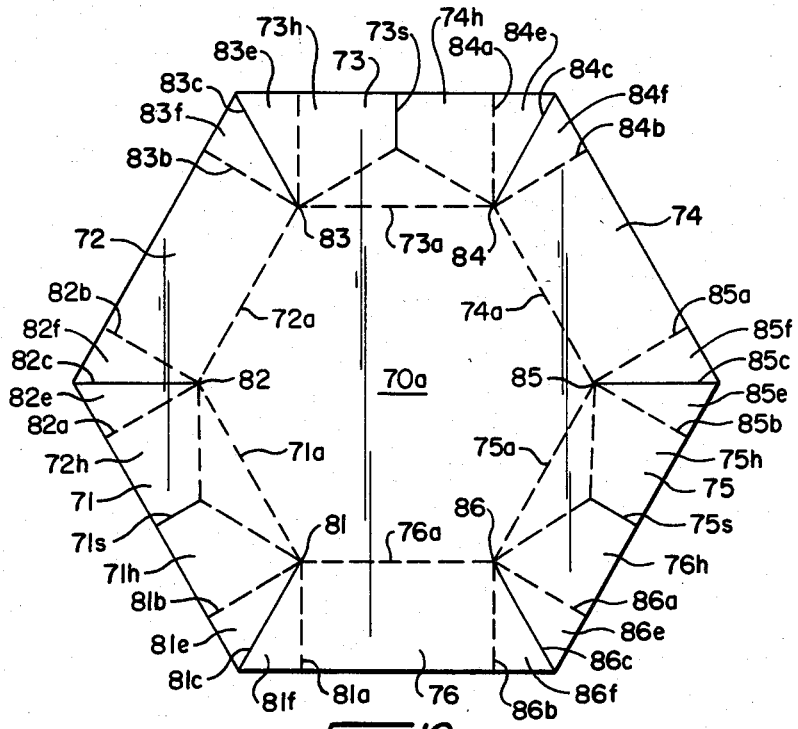
FIG. 10

FIG. 11
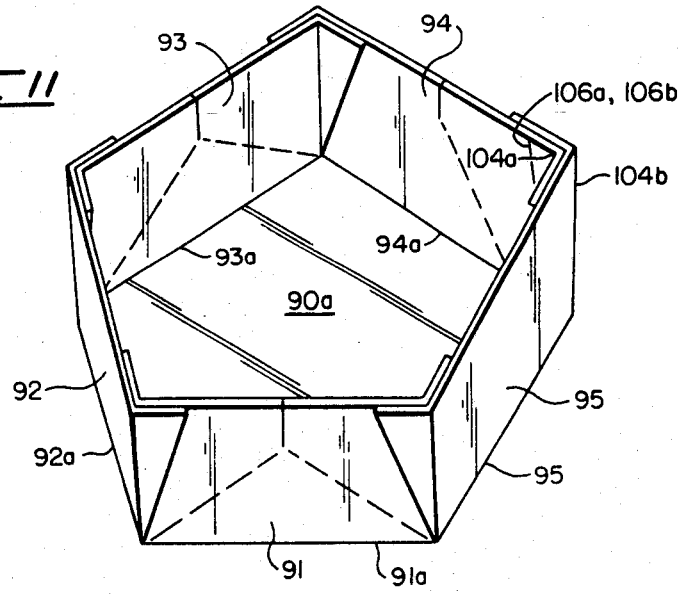
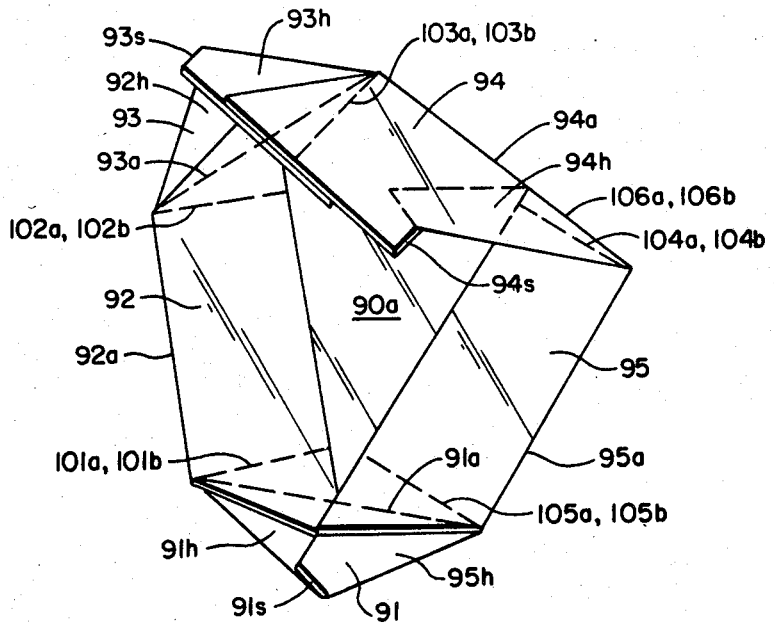
FIG. 12

FIBERBOARD FLAT WITH JOINED STRENGTHENED CORNERS FOR SETTING UP INTO AN ANGULAR TRAY AND THE SET-UP TRAY

BACKGROUND OF THE INVENTION AND PRIOR ACT

This invention relates generally to what are usually referred to in the art as trays and which are discussed specifically in U.S. Pat. No. 3,704,824. As stated in that patent, these trays are manufactured and sold in flat, knocked-down form and are therefore referred to as flats. That patent deals with forming strengthened corners in a flat between hinged side-wall flaps, the corners consisting of laminated connecting corner tabs which are arranged and maintained in superimposed relationship to produce a composite laminated flat corner structure, but which will not interfere with setting up the tray by merely folding outwardly the various flaps.

In the example disclosed in said patent, the flat was produced from a quadrangular sheet of suitable material scored and slit to provide a flat blank with the main flat wall and outwardly-extending hinged flaps at each edge thereof, the flaps being separated from each other at specifically formed corner slits running outwardly from the corner points of said wall. These slits and a pair of special adjacent corner fold score lines provided at each flap end, corner-connecting tabs of special form. The corner score lines at each corner were disposed at a right angle relatively and the slit at each corner extended outwardly from the junction of those score lines at an angle of 45° to provide a pair of corner-connecting tabs of mainly triangular form. The end of the adjacent flap was provided with a scored fold line which extended from the corner point, at the junction of the corner score lines, at a 45° angle relative to the adjacent corner fold score line and at a right angle relative to the corner slit into the flap and angularly to the outer edge thereof. Two of the opposed flaps of a first pair were folded inwardly and the two flaps of the second pair remained flat and extended outwardly so that the corner-connecting tabs were arranged in superimposed relationship and were maintained in that relationship by adhesive or otherwise to produce a composite laminated structure. The tray was set up for merely folding outwardly the first pair of flaps which automatically folded inwardly the second flat pair of flaps so that all the flaps were upstanding relative to the main flat wall. At the corner joints so produced by the connected tabs, there were two thicknesses of material with the tabs extending inwardly from the corner fold lines in opposite directions and overlapping the adjacent angularly disposed flaps which provide the side walls of flanges of the tray.

SUMMARY OF THE INVENTION

In order to be able to set up the flat into a tray, as indicated, by upstanding the flaps, the angular fold lines in the unfolded flat second or inner pair of flaps must be at angles of 45° relative to the adjacent corner fold score lines and substantially at right angles to the adjacent corner slits and these angular scored fold lines cannot converge within the flap, unless special provision is made to permit flap folding at said angular fold lines. It has been found that whether or not these angular scored fold lines converge before extending to the outer edge of the flap depends on the dimensions of the flap in which they are formed, that is, the relationship of depth of the flap to length of the flap. If they converge at any point within the flap, it is necessary to provide a separation in the flap extending from the point of convergence to the outer edge of the flap, this separation preferably being in the form of a slit extending from the convergence point to the outer edge of the flap. Without this separation in the flap material, it would be impossible for the first pair of flaps to be folded inwardly about the converging angular fold lines to bring the connected corner tabs into superimposed flat relationship in making the flat and subsequently in setting up the tray from the flat and subsequently for the first pair of flaps to be folded outwardly upright to pull the second pair of inner flaps upwardly and outwardly to the upright positions by the upward folding of the adjacent corner-connecting tabs which bend about the angular fold lines.

In flats for quadrangular trays or trays of even number of side flaps, this slit at the flat fold-line convergence point must be provided in alternating flaps. In the flats for trays that have uneven number of flaps, the slit must be provided in any flap that originally is not folded out of the plane of the main wall of the flat which may be termed an inner flat flap. But one of the originally flat flaps must be provided with independently foldable areas which can be folded in sequence.

BRIEF DESCRIPTION OF THE DRAWINGS

The best mode contemplated in carrying out this invention is illustrated in the accompanying drawings in which:

FIG. 3 is a plan view of the scored and slit blank used in forming the flat of FIG. 2.

FIG. 4 is a perspective view of a tray of regular octagonal form set up from a fiberboard flat embodying this invention.

FIG. 9 is a plan view of the scored and slit blank used in producing the folded flat of FIG. 8.

FIG. 10 is a plan view of a blank used in producing a folded flat for a hexagonal tray according to this invention.

FIG. 11 is a perspective view of a tray of pentagonal form set up from a flat according to this invention.

FIG. 12 is a perspective view of the flat used in setting up the tray of FIG. 11.

DETAILED DESCRIPTION OF THE INVENTION

Figure 1:
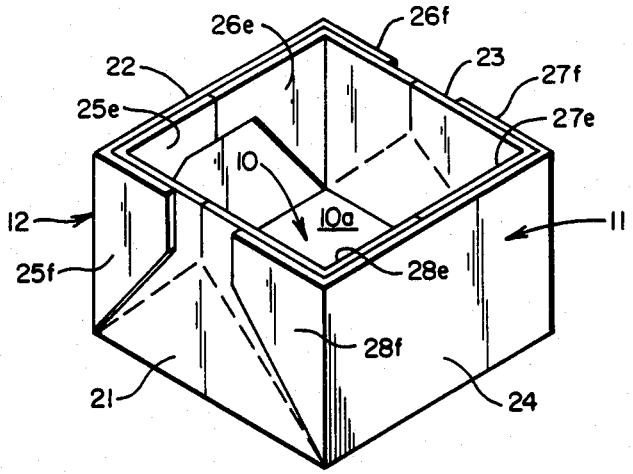
FIG. 1 is a perspective view of a square tray set up from a fiberboard flat embodying this invention.

With reference to FIG. 1 of the drawings, the completed set-up quadrangular tray ready for use according to the present invention is indicated as comprising a flat main wall 10 with a peripheral edge wall or flange 11 at a right angle to the plane thereof. In this illustration, the tray is square, the wall 10 is the bottom and the edge wall 11 is upstanding. In this upright position, the tray is suitable for use as a receptacle tray, as the bottom telescoping closure of a box or as the lower section of a fully telescoping box. In a position inverted from that shown, it is suitable for use as top telescoping closure of a box or as the upper section of a fully telescoping box. At each of the four corners of the tray, a special corner connecting joint 12 is provided which results in a double laminated thickness adjacent the corner and especially at the vertically disposed corner fold line. However, as indicated, this invention is not limited to a four-sided tray.

The flat for the tray is produced according to this invention, from the flat blank illustrated in FIG. 3. This blank may be formed from suitable sheets of material, such as corrugated fiber board, solid fiber board, paper board, or other sheet material capable of being slit, scored and folded. In this example, the blank is shown of square outline and as being provided with the main score lines 21*a*, 22*a*, 23*a* and 24*a* parallel to the respective outer edges of the blank and producing the respective hinged flaps 21, 22, 23, and 24 of equal length and which extend outwardly from the main wall portion 10*a* so as to be of equal depth. At the corners of the blank these adjacent angularly disposed main score lines intersect to provide the corner points 25, 26, 27 and 28, corresponding to the corners of the resulting flat wall portion 10*a*. The portions of the respective score lines extending beyond these corner points provide at the respective corners of the blank, pairs of corner fold lines 25*a*–25*b*, 26*a*–26*b*, 27*a*–27*b* and 28*a*–28*b*. All of these corner score lines preferably are more pronounced in that they are wider than the other score lines of the blank. At each corner between the fold lines of each pair of corner fold lines, a slit which is mainly diagonal, is made and these slits are designate 25*c*, 26*c*, 27*c* and 28*c* respectively. However, the outer end of each slit, indicated at 25*g*, 26*g*, 27*g* and 28*g*, respectively, is turned parallel to the respective adjacent corner scored fold line 25*b*, 26*b*, 27*b* or 28*b* and normal to the respective adjacent corner score line 25*a*, 26*a*, 27*a* or 28*a*. An additional angular score line is provided adjacent each corner of the blank and these lines are designated 25*d*, 26*d*, 27*d* and 28*d*, respectively. Each of these lines extends diagonally outwardly from the respective corner points 25, 26, 27 and 28 in diverging relationship to the respective slits 25*c*, 26*c*, 27*c* and 28*c*. In this square blank, the diagonal score lines 25*d*, 26*d*, 27*d* and 28*d* are at an angle of 45° relative to the respective corner fold lines 25*a*, 26*a*, 27*a* and 28*a*, and the flap fold lines 21*a*, 22*a*, 23*a*, and 24*a*, but the main parts of the substantially bisecting slits 25*c*, 26*c*, 27*c* and 28*c* will be at a slightly greater angle relative to these respective corner fold lines and at a lesser angle relative to the respective corner fold lines 25*b*, 26*b*, 27*b* and 28*b*. The indicated relative positioning of these diagonal fold lines and corner fold lines, results in the formation of foldable areas 25*h*, 26*h*, 27*h* and 28*h* on the respective flaps 21 and 23. The result of the described arrangement of corner score lines and slits is the formation of a pair of corner connecting tabs at each corner including an inner tab and an outer tab, the pairs being designated 25*e*–25*f*, 26*e*–26*f*, 27*e*–27*f* and 28*e*–28*f*. The corner tabs 25*f*, 26*f*, 27*f* and 28*f* will be the outer tabs in the set-up tray while the corner tabs 25*e*, 26*e*, 27*e* and 28*e* will be the inner tabs and are of special form and include the outer extensions 25*i*, 26*i*, 27*i* and 28*i*, which extend beyond the slit lines 25*c*, 26*c*, 27*c* and 28*c* that substantially bisects the right angles between the respective pairs of corner scores 25*a*–25*b*, 26*a*–26*b*, 27*a*–27*b* and 28*a*–28*b*.

In order to be able to form the proper flat from the square blank of FIG. 3 and to subsequently set-up the tray of FIG. 1 from that blank, the angular scored fold lines 25*d*, 26*d*, 27*d* and 28*d* must be at angles of substantially 45° relative to the respective corner fold lines 25*a*, 26*a*, 27*a* and 28*a* and these flap fold lines 21*d*, 22*d*, 23*d* and 24*d* are also at angles of substantially 90° relative to the bisecting tab-forming slits 25*c*, 26*c*, 27*c* and 28*c*. Therefore, in some instances, as indicated in the square blank of FIG. 3, depending on the proportion of length to depth of the flap in which these angular fold lines are formed, these angular lines will converge in the flap at a point spaced from the outer edge of the flap. This would prevent folding at these angular lines during forming and gluing of the flat and setting up the tray from the flat. Therefore, some means must be provided to permit this folding and this means must be a separation of material from the converging point to the outer edge of each flap, and this separation may be in the form of a notch or even a weakened tear line. Preferably this separation is in the form of a slit which extends from the point of convergence to the flap edge and which is designated 21*s* and 23*s* in the respective flaps 21 and 23 in this square blank.

Figure 2:
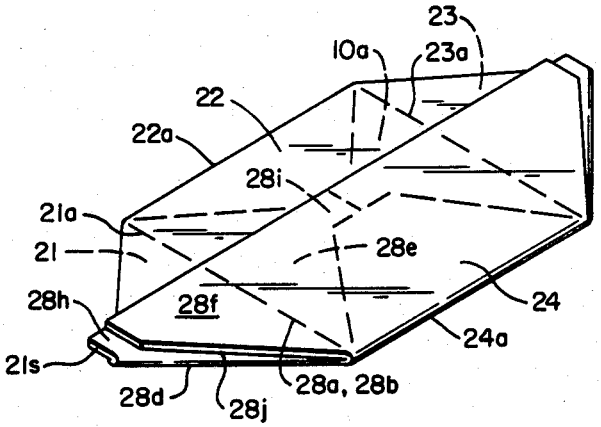
FIG. 2 is a perspective view of the folded flat with connected corners used in the set-up tray of FIG. 1 and shown in the form it is supplied to the user.

In forming the flat of FIG. 2 from the blank of FIG. 3, a first pair of flaps, consisting of the opposed flaps 22 and 24, is folded upwardly and inwardly and then downwardly with the flaps folding about their respective fold or hinge score lines 22*a* and 24*a*, while the outwardly extending flaps 21 and 23 are not folded but remain flat and in a common plane with the main wall portion 10*a*. In describing this folding operation, reference will be made to one corner only, but it will be understood that the same action will occur at each corner. At this one corner, before the flap 24 is folded inwardly and glued to tab 28*e* and area 28*h*, the corner-connecting tab 28*e*, along with the co-planer folding flap area 28*h*, is folded inwardly and upwardly about the diagonal score line 28*d* and then downwardly until it rests on the underlying areas of flap 21 and wall portion 10*a*, as shown in FIG. 2. Folding as indicated about diagonal score line 28*d* is permitted because of slit 21*s*. It will be noted that flap fold line 21*a*, corner fold 28*a* and corner fold line 28*b* will be in common alignment at this time. The outer corner connecting tab 28*f* remains in a common plane with the flap 24 and the flap will be pressed downwardly until it will be superimposed on the wall portion 10*a* and superimposed and glued to tab 28*e*, and the tab 28*f* will be superimposed and glued on the flap area 28*h*.

As stated above, before these surfaces of members 28*f* and 28*h*, and 24*f* and 28*e* are superimposed and moved into contact, they are coated with suitable adhesive and eventually are pressed together so that they will remain in an adhered oondition. It will be noted in FIG. 2 that the angular edge 28*j* of the tab 28*f* will be offset rearwardly of the angular fold line 28*d* to prevent accidental tearing loose of the tab 28*f*. This is the reason for offsetting the diagonal slit 28*c* of the blank, and corresponding slits at the other corners, as described. This offset should be at least as much as the thickness of the blank material. The described superimposed adhered areas will provide a composite laminated structure of double thickness with the corner fold lines 28*a* and 28*b* being in superimposed alignment and providing a double thickness at the resulting common corner fold line.

As previously indicated, the inner tab 28*e* is provided with the extenions 28*i* which will project outwardly beyond the diagonal part of the edge 28*c* of the tab. This serves as a reinforcing tab to prevent breaking of the flap 24 during set-up of the tray, which might occur along this diagonal part of edge 28*c*. Also, as previously indicated, the corner score lines such as score lines 28*a* and 28*b* are much deeper and wider than the other score lines. This will increase the tendency to fold at these corner score lines during setting up of the tray. Also, if during the lamination and gluing of the corner joints, the corner score lines 28*a* and 28*b* are misplaced slightly, they will still partially align since they are so wide.

In setting up the tray of FIG. 1 from the folded flat of FIG. 2, the opposed flaps 22 and 24 are folded outwardly and upwardly about their respective hinge lines 22*a* and 24*a* and the opposed flaps 21 and 23, because of the previously joined corners, are automatically folded inwardly about the respective fold lines 21*a* and 23*a*. As the flap 24 folds upwardly and outwardly, the outer corner tab 28*f* moves upwardly therewith and at the same time, folds inwardly about the corner fold line 28*b* at a right angle relative to the flap 24. The inner corner tab 28*e*, being secured to the flap 24, also moves outwardly with that flap and bends at the corner fold-line 28*a*. Simultaneously, the flap 21 is raised about the fold line 21*a* and moved inwardly and also bending about the angular fold line 28*d* until the flap area 28*h*, which bends about corner fold line 28*a*, is in a common plane with the main part of the flap 21. Because of the provision of slit 21*a* in flap 21 folding above angular line 28*d* is permitted. Also because of the provision of the wider and deeper corner score lines and the reinforcing extensions 25*i*, 26*i*, 27*i* and 28*i* on the inner flaps, the material of the flaps 22 and 24 will not tend to break along the angular lines 25*c*, 26*c*, 27*c* and 28*c* at the inner edges of connecting tabs 25*e*, 26*e*, 27*e* and 28*e*. Thus, all of the flaps 21, 22, 23 and 24 will be readily positioned upright substantially at right angles to the plane of the bottom portion 10*a* and provide the peripheral edge wall or flange 11.

It will be understood that each corner joint 12 (FIG. 1) will be of double-thickness at the final vertical corner fold-lines. The inner corner connecting tabs 25*e*, 26*e*, 27*e* and 28*e*, which are disposed inside the respective flaps 22 and 24 and are adhered to the inner surfaces thereof, in combination with the outer corner connecting tabs 25*f*, 26*f*, 27*f* and 28*f*, which overlap the respective flaps 21 and 23 and are adhered to the outer surfaces thereof, will provide a composite double laminated corner connecting structure. Since the overlapping layers, including the oppositely extending inner and outer corner-connecting tabs, which are disposed relatively at right angles, are adhered to adjacent surfaces of the side flaps, they serve to provide a composite laminated structure having a strength in combination greater than the sum total of the strength of each of the layers.

Since the flat is manufactured and supplied in the knocked-down condition illustrated in FIG. 2, storage and shipping will be facilitated as it will occupy a minimum of space. In the example shown, the flat can easily be set-up for use merely by outward folding of the one pair of flaps, which will automatically produce inward folding of the other pair, due to the previously joined corner structures. When set up, the corners will be of increased strength because of the adhered laminations providing double thickness of material at the corner fold lines. After some uses, the tray could again be knocked-down for storage.

As indicated in the following examples, this invention is applicable to angular trays of other than four sides, where there are angularly related side walls and it is desirable to provide connecting joints of increased strength at the angles between said side walls. Although in the square example given, it is preferred to provide the reinforcing extensions 25*i*, 26*i*, 27*i* and 28*i* on the inner flaps 25*e*, 26*e*, 27*e* and 28*e*, these may be eliminated and the tabs will be of triangular form. Also, in this square example, it is preferred to provide the offset angular edge 28*j* on tab 28*f* and similar offsets on the other corresponding tabs, but these can be eliminated. Therefore, in the following examples for sake of simplicity of disclosure, these reinforcing extensions and offset edges will not be described, but could be present.

Figure 6:
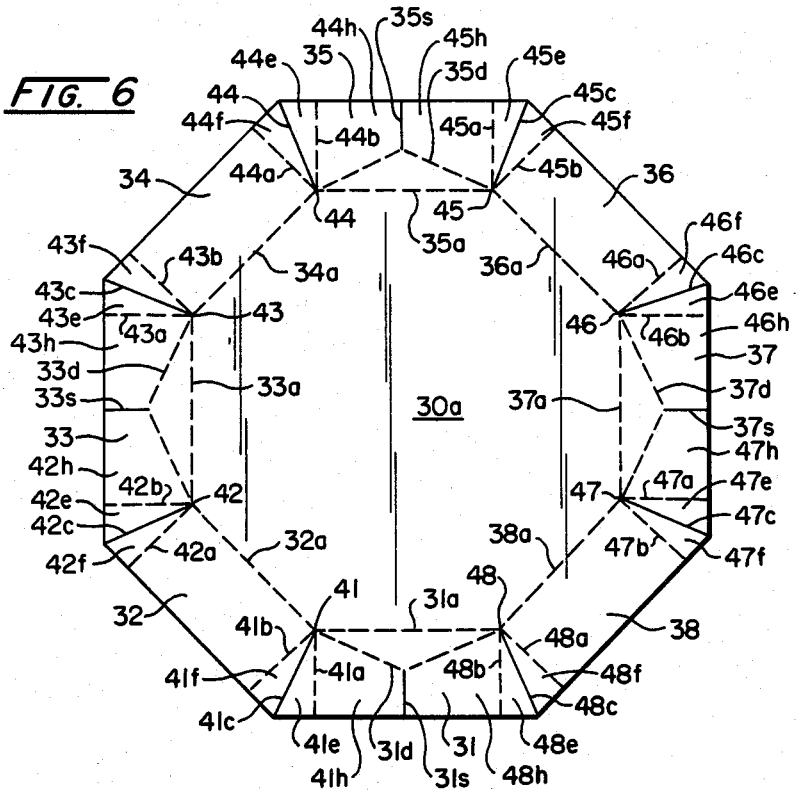
FIG. 6 is a plan view of the scored and slit blank used in forming the flat of FIG. 5.

In FIG. 4, there is illustrated an embodiment of this invention in the form of a tray of regular octagonal form. The blank for producing this tray is shown in FIG. 6 and is provided with the main score lines 31*a*, 32*a*, 33*a*, 34*a* and 35*a*, 36*a*, 37*a* and 38*a* parallel to the respective outer edges of the blank to produce the respective eight hinged side wall forming flaps 31, 32, 33, 34, 35, 36, 37 and 38 which in this example are of equal length and extend outwardly from the main flat portion 30*a* so as to be of equal depth. At the corners of the blank, these adjacent angularly disposed score lines interest to provide the corner points 41, 42, 43, 44, 45, 46, 47 and 48 corresponding to the corners of the resulting flat wall portion 30*a*. At the respective corners of the blank, pairs of wide corner fold lines 41*a*–41*b*, 42*a*–42*b*, 43*a*–43*b*, 44*a*–44*b*, 45*a*–45*b*, 46*a*–46*b*, 47*a*–47*b*, and 48*a*–48*b* are provided. Each of these pairs is bisected by a slit designated respectively 41*c*, 42*c*, 43*c*, 44*c*, 45*c*, 46*c*, 47*c* and 48*c*. Each slit extends outwardly from its respective corner point and with the associated corner fold lines provides the respective pairs of corner tabs of triangular form which are designated 41*e*–41*f*, 42*e*–42*f*, 43*e*–43*f*, 44*e*–44*f*, 45*e*–45*f*, 46*e*–46*f*, 47*e*–47*f*, 48*e*–48*f*. The alternating flaps 31, 33, 35 and 37 are provided with additional angular scored fold lines arranged in converging pairs in each flap and designated respectively 31*d*, 33*d*, 35*d* and 37*d* in the respective flaps. It will be noted that each of these pairs converging at a point which is midway of the length of the flap and spaced inwardly from the outer edge of that flap. This is because each of these flap fold lines, as previously indicated, must be at substantially a right angle relative to the adjoining corner slit 41*c*, 42*c*, 43*c*, 44*c*, 45*c*, 46*c*, 47*c* and 48*c*, which slits substantially bisect the respective spaces between the pairs of corner fold lines 41*a*–41*b*, 42*a*–42*b*, 43*a*–43*b*, 44*a*–44*b*, 45*a*–45*b*, 46*a*–46*b*, 47*a*–47*b* and 48*a*–48*b*. As previously indicated, to permit folding of the respective alternating flaps 32, 34, 36 and 38 in making the flat, gluing and setting up the tray from the flat, a separation, preferably in the form of a slit, extends from the point of convergence of the angular fold lines to the outer edge of the respective flap. These slits are designated 31*s*, 33*s*, 35*s* and 37*s*, respectively. As the angle between adjacent flap hinge lines, such as 31*a* and 32*b* increases the point of convergence of fold lines, 31*d* will move inwardly towards the hinge line 31*a* and the depth of slot 31*s* will necessarily increase. For example, in the square form of FIG. 3, such an angle is a right angle and in this octagon form the angle increases to an obtuse angle.

Figure 5:
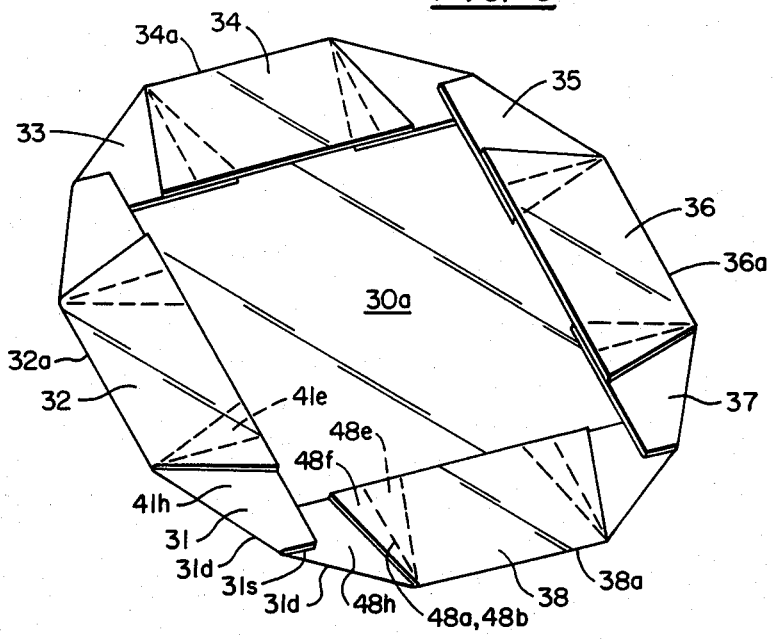
FIG. 5 is a perspective view of the folded flat used in the set-up tray of FIG. 4.

In forming the flat of FIG. 5 from the blank of FIG. 6, the alternating flaps 32, 34, 36 and 38 are folded upwardly and inwardly and then downwardly with the flaps folding about their respective fold or hinge lines 32*a*, 34*a*, 36*a* and 38*a* while the outwardly extending flaps 31, 33, 35 and 37 are not folded, but remain flat and in a common plane with the main wall portion 30*a*. In describing this folding operation, reference will be made to one corner only as before. At this one corner before the flap 38 is folded inwardly and glued to the tab 48*e* and foldable flap area 48*h*, the corner-connecting tab 48*e* along with coplanar flap area 48*h* is folded inwardly and upwardly about the angular score line 31*d* and then downwardly until it rests on the underlying areas of flap 31 and wall portion 30*a* as is shown in FIG. 5. Folding as indicated about angular score line 31*d* is permitted because of slit 31*s*. It will be noted that corner fold line 48*a* and corner fold line 48*b* will be in common alignment at this time. The outer corner connecting tab 48*f* remains in a common plane with the flap 38 and the flap 38 will be pressed downwardly until it will be superimposed on the wall portion 30*a* and superimposed and glued to tab 48*e* and the tab 48*f* will be superimposed and glued on the flap area 48*h*. When the corner-connecting tab 41*e* at the opposite corner, along with coplaner flap area 41*h* is folded upwardly and inwardly about the angular score line 31*d* and then downwardly, this foldable area 41*h* overlaps foldable flap area 48*h*, which is permitted because of slit 31*s*. The flat of FIG. 5 is set up into the tray of FIG. 4 substantially in the same manner as setting up the flat of FIG. 2 into the tray of FIG. 1.

Figure 7:
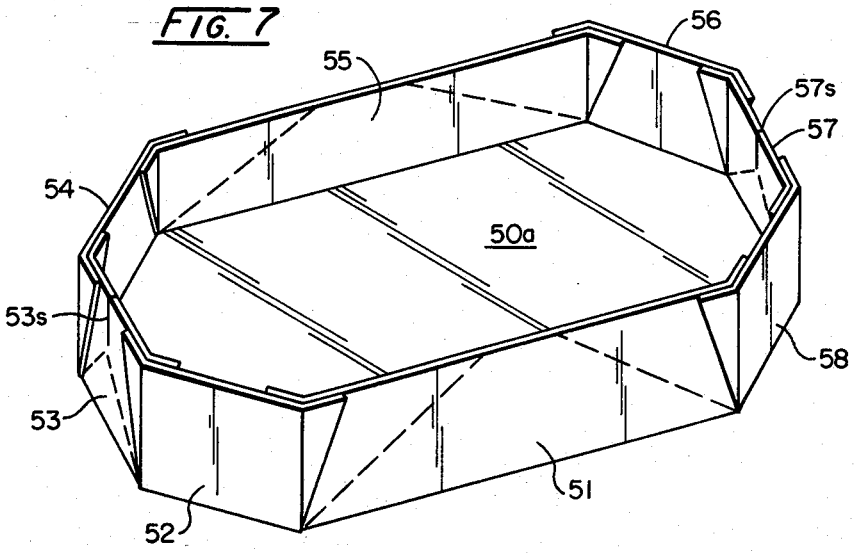
FIG. 7 is a perspective view of a tray of irregular octagonal form set up from a fiberboard flat embodying this invention.

In FIG. 7, there is illustrated another embodiment of the invention in the form of a tray of irregular octagonal form. The blank for producing this tray is shown in FIG. 9 and is provided with the main score lines 51*a*, 52*a*, 53*a*, 54*a*, 55*a*, 56*a*, 57*a* and 58*a* parallel to the respective outer edges of the blank to produce the respective eight hinged side-wall forming flaps 51, 52, 53, 54, 55, 56, 57 and 58 which extend outwardly from the main flat wall portion 50*a* and are of equal depth. However, the flaps 51 and 55 are of greater length than the others. At the corners of the blank, these adjacent angularly disposed score lines intersect to provide the corner points 61, 62, 63, 64, 65, 66, 67 and 68 corresponding to the corners of the resulting flat wall portion 50*a*. At the respective corners of the blank, pairs of wide corner fold lines 61*a*–61*b*, 62*a*–62*b*, 63*a*–63*b*, 64*a*–64*b*, 65*a*–65*b*, 66*a*–66*b*, 67*a*–67*b* and 68*a*–68*b* are provided. Each of these pairs is bisected by a slit designated respectively 61*c*, 62*c*, 63*c*, 64*c*, 65*c*, 66*c*, 67*c*, and 68*c*. Each slit extends outwardly from its respective corner point and with associated corner fold lines provides the respective pairs of corner tabs of tri-angular form which are designate 61*e*–61*f*, 62*e*–62*f*, 63*e*–63*f*, 64*e*–64*f*, 65*e*–65*f*, 66*e*–66*f*, 67*e*–67*f* and 68*e*–68*f*. The alternating flaps 51, 53, 55, and 57 are provided with additional angular scored fold lines arranged in pairs in each flap and designated respectively 51*d*, 53*d*, 55*d* and 57*d*. In the opposed longer flaps 51 and 55, the pairs of angular fold lines 51*d* and 55*d* do not converge within the respective flap because the flaps are relatively long compared to their depth. Thus, triangular foldable flap area 61*h*–68*h* and 64*h*–65*h* are formed. However, in the opposed shorter flaps 53 and 57, the angular fold lines 53*d* and 57*d* do converge within the respective flaps forming flap areas 62*h*–63*h* and 66*h*–67*h* with slits 53*s* and 57*s*. This is because each of the angular flap fold lines must be substantially at a right angle relative to the adjacent corner slit 61*c*, 62*c*, 63*c*, 64*c*, 65*c*, 66*c*, 67*c* and 68*c*, which slits substantially bisect the respective spaces between the pairs of corner fold lines 61*a*–61*b*, 62*a*–62*b*, 63*a*–63*b*, 64*a*–64*b*, 65*a*–65*b*, 66*a*–66*b*, 67*a*–67*b* and 68*a*–68*b*. As previously indicated, to permit folding of the respective flap areas of flaps 53 and 57 in which the flap fold lines 53*d* and 57*d* converge, during the making and gluing of the flat, and setting up the tray from the flat, a separation, preferably a slit, extends from the point of convergence of the angular fold lines to the outer edge of the respective flaps. These slits are designated 53*s* and 57*s* and are mentioned above.

FIG. 9 brings out that whether or not such slits are needed depends on the proportion of length to depth of the flap. Also, that such slits are necessary in an irregular shaped octagon.

Figure 8:
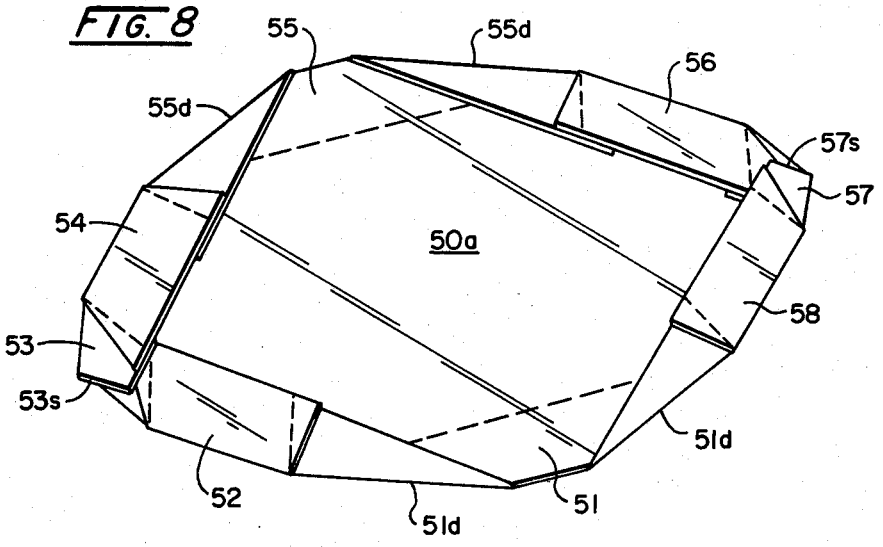
FIG. 8 is a perspective view of the folded flat used in producing the set-up tray of FIG. 7.

To fold and glue the blank of FIG. 9 into the flat of FIG. 8, each corner is folded in substantially the same manner as previously described with reference to the blank of FIG. 6, with the exception that the slits in flaps 51 and 55 are not necessary because angular fold lines 51*d* and 55*d*, in the respective flaps, do not converge within the flaps because of the proportion of flap length to flap depth as mentioned above. The flat of FIG. 8 is set up into the tray of FIG. 7 substantially in the same manner as setting up the flat of FIG. 5 into the tray of FIG. 4.

FIG. 10 shows a blank for producing a folding flat which can be set up into a tray of regular hexagonal form according to this invention. This blank is similar to the blank shown in FIG. 6 for the regular octagonal tray and, therefore, the flat and the final tray need not be shown and described. In this example, all the flaps are of equal length and the alternate flaps have the angular flap fold lines as in the regular octagon form. Specifically, the blank is provided with the main score lines 71*a*, 72*a*, 73*a*, 74*a*, 75*a* and 76*a* parallel to the respective outer edges of the blank to produce the respective six hinged side-wall forming flaps 71, 72, 73, 74, 75 and 76 of equal length and depth which extend outwardly from the main flat wall portion 70*a*. The corner points of the flat wall portion 70*a* are illustrated at 81, 82, 83, 84 85 and 86 and at these respective corners pairs of wide corner fold lines 81*a*–81*b*, 82*a*–82*b*, 83*a*–83*b*, 84*a*–84*b*, 85*a*–85*b*, 86*a*–86*b* are provided. Each of these pairs is bisected by a respective slit 81*c*, 82*c*, 83*c*, 84*c*, 85*c* and 86*c*. Each slit extends outwardly from its respective corner and with associated corner fold lines provides the respective pairs of corner tabs of triangular form 81*e* ∝ 81*f*, 82*e*–82*f*, 83*e*–83*f*, 84*e*–84*f*, 85*e*–85*f* and 86*e*–86*f*. The alternating flaps 71, 73 and 75 are provided with additional angular scored fold lines arranged in converging pairs in each flap and are designated respectively 71*d*, 73*d* and 75*d*, each of these being at a right angle to its associated slit. Since each of these pairs of fold lines converge within its respective flap to permit folding of the blank into the flat and setting up of the tray from the flat, it is necessary to provide the slits 71*s*, 73*s* and 75*s* extending from the respective convergence points to the outer edge of the flap and pairs of flap areas 71*h*, 72*h*, 73*h*, 74*h*, 75*h*, and 76*h* are thus produced. The flat can be produced by folding in the same manner as described with reference to the octagon flat of FIG. 5 and the tray set-up therefrom in the manner described with reference to FIG. 4.

Figure 13:
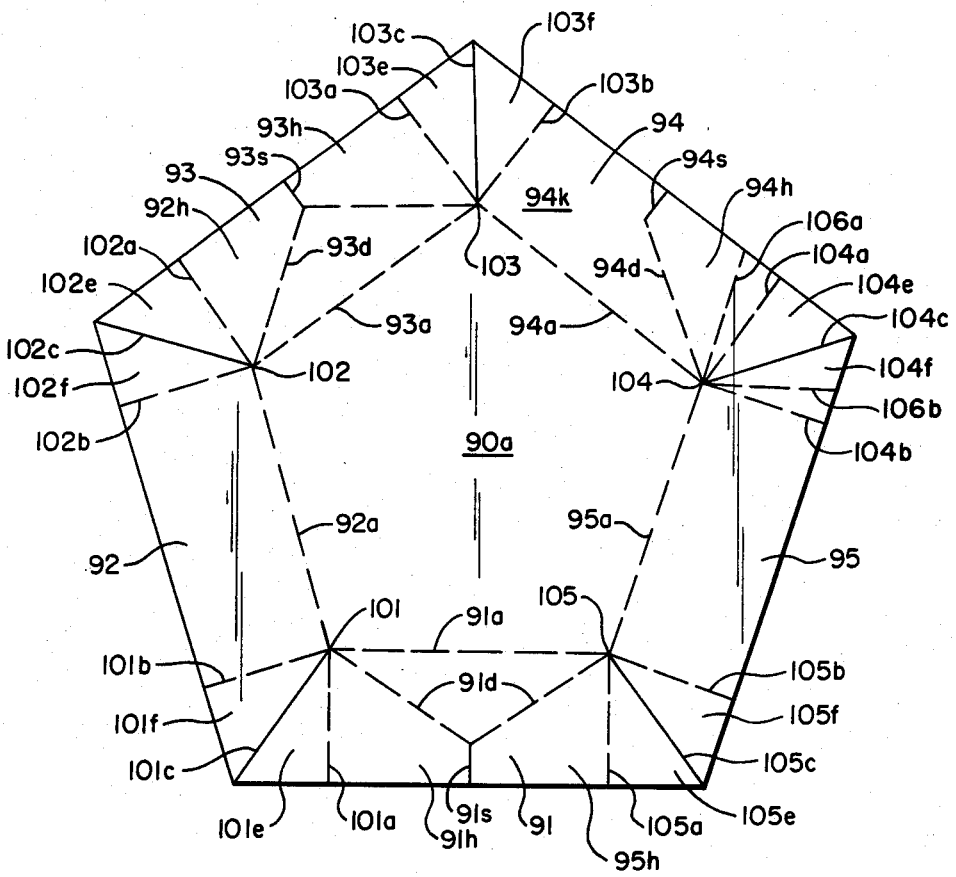
FIG. 13 is a plan view of the blank used in forming the flat of FIG. 12.

With reference to FIGS. 11 to 13, there is shown an embodiment of the invention in a tray of an uneven number of sides, specifically five sides in this example. For a tray of uneven number of sides, alternate flaps fold in and out in the same manner as in the flat for a tray of even number of sides, but one flap will be different in that it will include a portion which will fold inwardly and a portion which initially remains flat and later will fold inwardly.

The five-sided tray of this example is illustrated in FIG. 11 and is made from the folded flat of FIG. 12 which is produced from the blank of FIG. 13. In this example, all the flaps are of equal length and depth and are numbered 91, 92, 93, 94 and 95, and fold about hinge lines 91*a*, 92*a*, 93*a*, 94*a* and 95*a*. They are arranged around the flat main wall portion 90*a*. The corner points of the flat wall portion are numbered 101, 102, 103, 104 and 105 and at these respective corners pairs of wide corner fold lines 101*a*–101*b*, 102*a*–102*b*, 103*a*–103*b*, 104*a*–104*b* and 105*a*–105*b* are provided. Each of these pairs is bisected by a respective slit 101*c*, 102*c*, 103*c*, 104*c* and 105*c*. Each slit extends outwardly from its respective corner and with associated corner fold lines provides the respective pairs of corner tabs of triangular form 101*e*–101*f*, 102*e*–102*f*, 103*e*–103*f*, 104*e*–104*f* and 105*e*–105*f*. As before, alternating flaps 91 and 93 are provided with additional angular scored fold lines arranged in converging pairs in each flap and are designated respectively 91*d* and 93*d*. However, in this five-sided example, the one flap 94 is different in that it has only one scored fold line 94*d* which extends from corner point 104 at a right angle to the corner slit 104*c*, but terminates inwardly from the outer edge of flap 94. From this termination point to the flap edge, a slit 94*s* is provided. This divides the flap 94 into portions 94*h* and 94*k*. Also at this corner 104, an additional scored fold line 106*a* is provided which converges with corner fold line 104*a* and aligns with flap hinge line 95*a*. It will be noted that the corner fold line 106*a* with the angular scored fold line 94*d* provide a foldable flap area 94*h*. Also, an extra scored fold line 106*b*, in this instance, is provided between the corner slit 104*c* and corner fold line 104*b*. In the flap 91, the pair of angular fold lines 91*d* with the slit 91*s* produce the two foldable flap areas 91*h* and 95*h*. Similarly in the flap 93, the pair of angular fold lines 93*d* with slit 93*s* provides the foldable flap areas 92*h* and 93*h*.

To fold and glue the blank of FIG. 13 into the flat of FIG. 12, the outwardly extending flaps 92, 94 and 95 are folded upwardly and inwardly and then downwardly with the flaps folding about the respective hinge lines 92*a*, 94*a*, 95*a*, while the outwardly extending flaps 91 and 93 are not folded, but remain flat and in a common plane with main wall portion 90*a*. Flap 94 in this example as stated above, has portions 94*h* and 94*k* which can be folded separately due to the provision of fold lines 94*d* and 106*a*. To fold and glue corners 102, 102 and 105, substantially the same procedure is followed as previously described with reference to the other examples. However, corner 104 is different because this tray has an odd number of sides and this causes a difference in folding it and corner 103. After the coplanar flap areas 104*e* and 94*h* of flap 94 have been folded about angular fold line 94*d* and the flap 95 has been folded inwardly and glued to the coplaner areas 104*e* and 94*h*, it being understood that flap portion 94*k* is in its original flat position, the coplanar flap areas 103*e* and 93*h* of adjacent flat flap 93 are then folded upwardly, and then downwardly. It will be noted that fold line 106*a* aligns with flap hinge line 94*a*. The flap 94 is now folded upwardly, inwardly and downwardly about fold lines 94*a*, 106*a* and 106*b* causing areas 103*e* and 93*h* of flap 93 to be contacted and glued to areas 103*f* and 94*k* of flap 94. It will be noted that fold line 106*b* also aligns with flap hinge line 94*a*.

Setting up the tray of FIG. 11 from the flat of FIG. 12 will be substantially the same as setting up the flats previously described.

It will be apparent from the above that this invention provides for the production of flats of an equal or unequal number of sides and in each flat the corners are laminated in such a manner that when the tray is set up therefrom, it has strengthened corners. Angular fold line are provided in the side-wall forming flaps which provide foldable flap sections that must be folded inwardly. When these lines terminate at a point within the outer edges of the respective flaps, the material of the flap must be separated or slit at that point. These angular scored fold lines must be substantially at a right angle to the respective adjacent corner slits which substantially bisect the angles between the adjacent corner fold lines to produce the inner and outer corner connecting tabs. In the flats for trays of an equal number of sides, the alternating flaps have a pair of converging angular fold lines which provide the foldable flap sections on the ends of such flaps. In the flaps for trays of an odd number of sides, alternating flaps have the pair of converging angular fold lines and the final odd flap has only one angular fold line which along with its associates flap slit divides that flap into independently foldable flap sections which can be folded in sequence. As pointed out, before the flap slits extending from the angular fold lines are necessary when the angular lines or line terminate within the respective flaps due to the proportion of length to depth of the flap. It will be apparent from the drawings that as the number of sides of the flat increase, the angle between the flap hinge line and the angular fold lines or line associated therewith decrease which results in the need for the flap slits.

I claim:

1. A flat for use in setting up a tray-like article which has a substantially flat-wall with side walls at its periphery that are angualarly disposed relative to each other and connected at the angular joints therebetween, said flat comprising:

a substantially flat-wall portion of angular peripheral outline having scored hinge fold lines adjacent all its edges;

side-wall producing flaps attached to said flat wall portion around its periphery at the respective scored hinge fold lines and having opposed ends with their respective ends adjacent each and their respective outer edges free;

said flaps comprising first and second flaps around the periphery of said flat-wall portion with the first flaps extending outwardly from their respective scored hinge fold lines in a substantially common plane with said flat-wall portion and with the second flaps turned inwardly about their respective scored hinge fold lines into overlapping relationship with said flat-wall portion;

structures at each joint for connecting together said adjacent ends of said first and second flaps and comprising:

an outwardly-extending corner tab on the said end of the second flap;

an inwardly-folded connecting flap section on the said end of the first flap carrying an inwardly-extending corner tab which is in superimposed relationship and in flat contact with said second flap and is secured thereto;

said outwardly-extending corner tab extending outwardly in superimposed relationship and in flat contact with inwardly-folded connecting flap section and being secured thereto;

said outwardly-extending corner tab being connected to said second flap at a scored corner joint fold line and said inwardly-extending tab being connected to said connecting section at a scored corner joint fold line, the two scored corner joint fold lines being superimposed to provide a common joint fold line;

said common corner joint fold line being in alignment with the scored hinge fold line of said first flap;

said inwardly-folded flap connecting section on the first flap being folded inwardly about an angular scored fold line at an angle relative to said common joint corner fold line to provide said connecting flap section;

said angular scored fold line extending from the flap scored hinge line of the first flap at an angle relative to it and to said common corner joint fold line but terminating at a point within the flap; and a flap separation extending from the termination point to the edge of said first flap producing relatively foldable sections within the flap;

said tray-like article having an unequal number of the side walls and comprising the flat wall portion with an unequal number of flaps around its periphery;

said unequal number of flaps alternating in the first and second flaps around its periphery and having an odd flap which is originally flat and is divided into independently foldable sections by a single angular fold line which extends from an adjacent common corner joint fold line to a termination point within the odd flap; and said separation extending from the termination point to the edge of said odd flap producing relatively foldable sections within that flap.

2. A tray-like article set up from the flat of claim 1 by folding the said second flaps outwardly about their respective hinge fold lines so as to automatically fold the said connected first flaps inwardly about their respective hing fold lines.

3. A flat according to claim 1 in which:

the said odd flap with the said single angular fold line is provided with an additional scored corner fold line which extends at an angle from the said single angular fold line and aligns with the hinge line of the adjacent first flap and that first flap is provided with an additional scored corner fold line extending at an angle relative to the said single angular fold line between the adjacent corner slit and corner fold line.

4. A tray-like article set up from the flat of claim 3 by folding the said second flaps outwardly about their respective hinge fold lines so as to automatically fold the said connected first flaps inwardly about their respective hinge fold lines.

5. A blank for use in forming a tray-like article comprising a flat sheet of fiberboard or the like having:

main hinge score lines parallel to the respective outer edges of the sheet to produce adjacent hinged side-forming flaps extending outwardly from a main wall portion formed within said hinge lines, the hinge lines meeting to provied corner points;

pairs of corner fold lines extending outwardly at an angle relatively at said corner points;

a corner slit between each pair of corner fold lines which substantially bisects the angle therebetween;

an angular score line at a corner in one of the adjacent flaps extending outwardly from the corner point substantially at a right angle relative to said corner slit and at an angle to the hinge line of the flap in which it is formed and terminating at a point within that flap; and a flap separation extending from the termination point to the edge of said flap in which said angular score line is formed producing relatively foldable sections within the flap;

said tray-like article having an unequal number of sides said flaps being arranged in an unequal number around the flat wall portion;

said flaps alternating in the first and second flaps around its periphery and having an odd flap which is divided into independently foldable sections by a single angular fold line which extends from an adjacent common corner joint fold line to termination point within the odd flap; and said flap separation extending from the termination point to the edge of said odd flap producing relatively foldable sections within that flap.

6. A blank according to claim 5 in which:

the said odd flap with the said single angular fold line is provided with an additional corner fold line which extends at an angle from the said single angular fold line and aligns with the hinge line of the adjacent first flap and that first flap is provided with an additional corner scored fold line extending at an angle relative to the said single angular fold line between the adjacent corner slit and corner fold line.

* * * * *